US005935011A

United States Patent [19]

Morgan et al.

[11] Patent Number: 5,935,011

[45] Date of Patent: Aug. 10, 1999

[54] WHEELCHAIR ACCESSIBLE CAROUSEL VEHICLE

[75] Inventors: Dana H. Morgan; George Olson, both of La Selva Beach; Christian Lauren, Thousand Oaks, all of Calif.

[73] Assignee: Universal City Studios, Inc., Universal City, Calif.

[21] Appl. No.: 09/070,275

[22] Filed: Apr. 30, 1998

[51] Int. Cl.[6] ..... A63G 1/48

[52] U.S. Cl. ..... 472/29; 472/36; 14/695; 414/462

[58] Field of Search ..... 472/2, 3, 29, 36, 472/37, 38, 40, 42, 43; 14/69.5, 71.1; 414/462, 537, 921

[56] References Cited

U.S. PATENT DOCUMENTS

| | | | |
|---|---|---|---|
| 1,717,303 | 6/1929 | Barclay . | |
| 1,919,467 | 7/1933 | Jewell . | |
| 2,063,468 | 12/1936 | Spillman . | |
| 3,730,361 | 5/1973 | Haynes . | |
| 3,955,847 | 5/1976 | Schiowitz . | |
| 4,103,934 | 8/1978 | Arnholt et al. . | |
| 4,522,390 | 6/1985 | Kudler | 472/3 |
| 4,759,682 | 7/1988 | Hood . | |
| 4,865,312 | 9/1989 | Katz . | |
| 5,026,243 | 6/1991 | Dell | 414/537 X |
| 5,160,236 | 11/1992 | Redding et al. | 414/537 |
| 5,259,081 | 11/1993 | Henderson . | |
| 5,380,144 | 1/1995 | Smith et al. . | |
| 5,393,192 | 2/1995 | Hall et al. . | |
| 5,564,984 | 10/1996 | Mirabella et al. . | |

OTHER PUBLICATIONS

Brochure, "Creating Excitement at your park! For The Time Of Your Life", Chance Rides, Inc. 1996, 2 pages.

Brochure, "The 20' Fantasy Carrousel Park Model", Chance Rides, Inc., 2 pages.

Brochure, "The 28' Americana Carrousel Park Model", Chance Rides, Inc., 2 pages.

Brochure, "The 36' Classic Carrousel Park Model", Chance Rides, Inc., 2 pages.

Brochure, "The 50' Grand Carrousel Park Model", Chance Rides, Inc., 2 pages.

*Primary Examiner*—Kien T. Nguyen

*Attorney, Agent, or Firm*—Lyon & Lyon LLP

[57] ABSTRACT

A carousel has a ramp for providing wheelchair access. The ramp is slidably stored on the underside of the carousel platform. In use, the ramp is pulled out from the carousel and is then unfolded, using a lever handle. The outer or bottom end of the lower ramp section rests on the ground. The inner or upper end of the second ramp section is positioned on the top surface of the carousel platform, or on a raised vehicle platform above the carousel platform. A wheelchair can then roll up the ramp and onto the carousel. The wheelchair is secured into a vehicle, such as a chariot, on the carousel. The vehicle oscillates vertically, to provide the wheelchair passenger with a more traditional and enjoyable carousel ride experience.

22 Claims, 5 Drawing Sheets

WHEELCHAIR ACCESSIBLE CAROUSEL VEHICLE

BACKGROUND OF THE INVENTION

Wheelchair-bound persons are often unable to fully participate in and enjoy certain amusement rides, due to inaccessibility of the ride vehicle. While some ride vehicles can accommodate the physically challenged, they sometimes do not provide the same ride experience or have been modified in ways which limit the thrill or enjoyment of the ride. Carousels, although one of the oldest types of ride attractions, still remain a favorite ride today, especially among children. In traditional carousel-type rides, character vehicles (e.g., horses) move up and down relative to the rotating carousel platform, while chariot or other types of vehicles having conventional seats remain fixed and do not move relative to the rotating platform.

Although these chariots and other types of vehicles may be able to physically accommodate a rider in a wheelchair, the rider must first be able to gain entry into the vehicle. However, even then, the physically challenged rider would not have the same ride experience as riders on the moving vehicles, such as the traditional horses, because the fixed vehicle does not move up and down. As the carousel platform is typically raised up above the ground surface, and as the carousel must preferably be free to start and stop at any angular position, providing access to the physically challenged presents various design obstacles which are not readily overcome using conventional techniques. Moreover, for both aesthetic and practical reasons, the perimeter area of the carousel should be free of obstructions when the carousel is in use. Most conventional ways for providing access cannot readily meet these design goals. While access ramps for the physically challenged have been used with carousels, they generally have had significant limitations in providing safe yet quick loading and unloading.

Accordingly, it is an objective of the invention to provide an improved access system for the physically challenged in an amusement ride, and particularly on a carousel. It is also an objective of the invention to allow more physically challenged persons to share the entertainment experience provided by amusement and theme park rides.

SUMMARY OF THE INVENTION

This and other related objects are achieved according to the invention by a carousel ride having an extendable wheelchair ramp which is preferably mounted to a turntable platform of the carousel. In use, the ramp advantageously extends from a loading level (e.g., the ground or the floor) to the turntable platform. In a preferred embodiment, the wheelchair ramp is mounted to the turntable platform to allow the ramp to be retracted under the turntable platform to be out of the way and substantially hidden when not in use. A vehicle, such as a chariot is advantageously positioned on the turntable platform, with ramp extendable up to or in the chariot. The chariot is preferably moved up and down, to provide a physically challenged rider with a ride experience similar to the ride experience provided to other riders.

BRIEF DESCRIPTION OF THE DRAWINGS

Other objects and features of the present invention will become apparent from the following detailed description taken in connection with the accompanying drawings. It is to be understood, however, that the drawings are designed solely for illustration purposes, and are not intended to define the scope of the invention.

In the drawings, wherein similar reference characters denote similar elements throughout the several views.

DETAILED DESCRIPTION OF THE DRAWINGS

Figure 1:
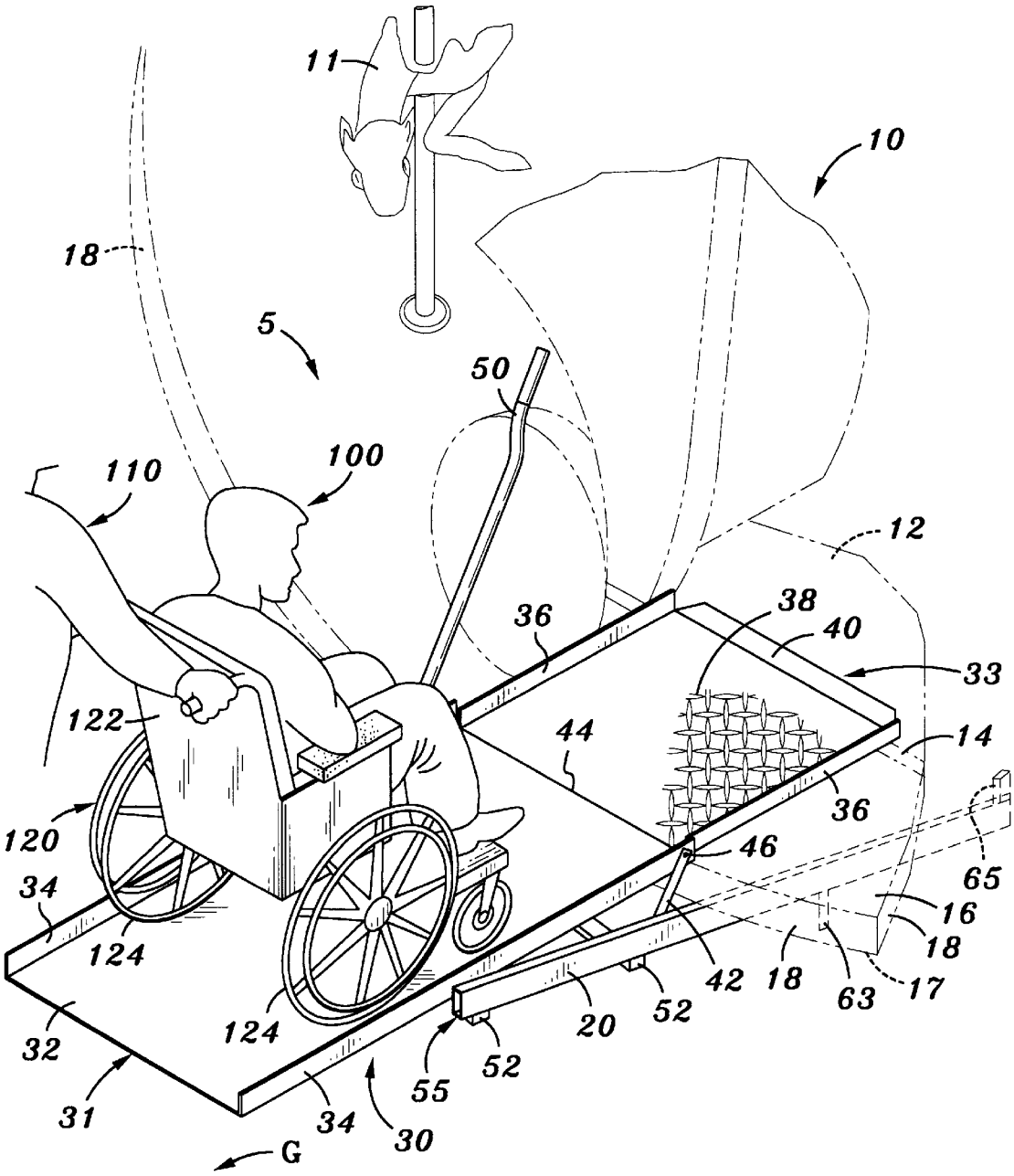
FIG. 1 is a perspective view of a carousel chariot vehicle, a turntable platform and a fully deployed wheelchair ramp, according to the preferred embodiment of the present invention.
Figure 2:
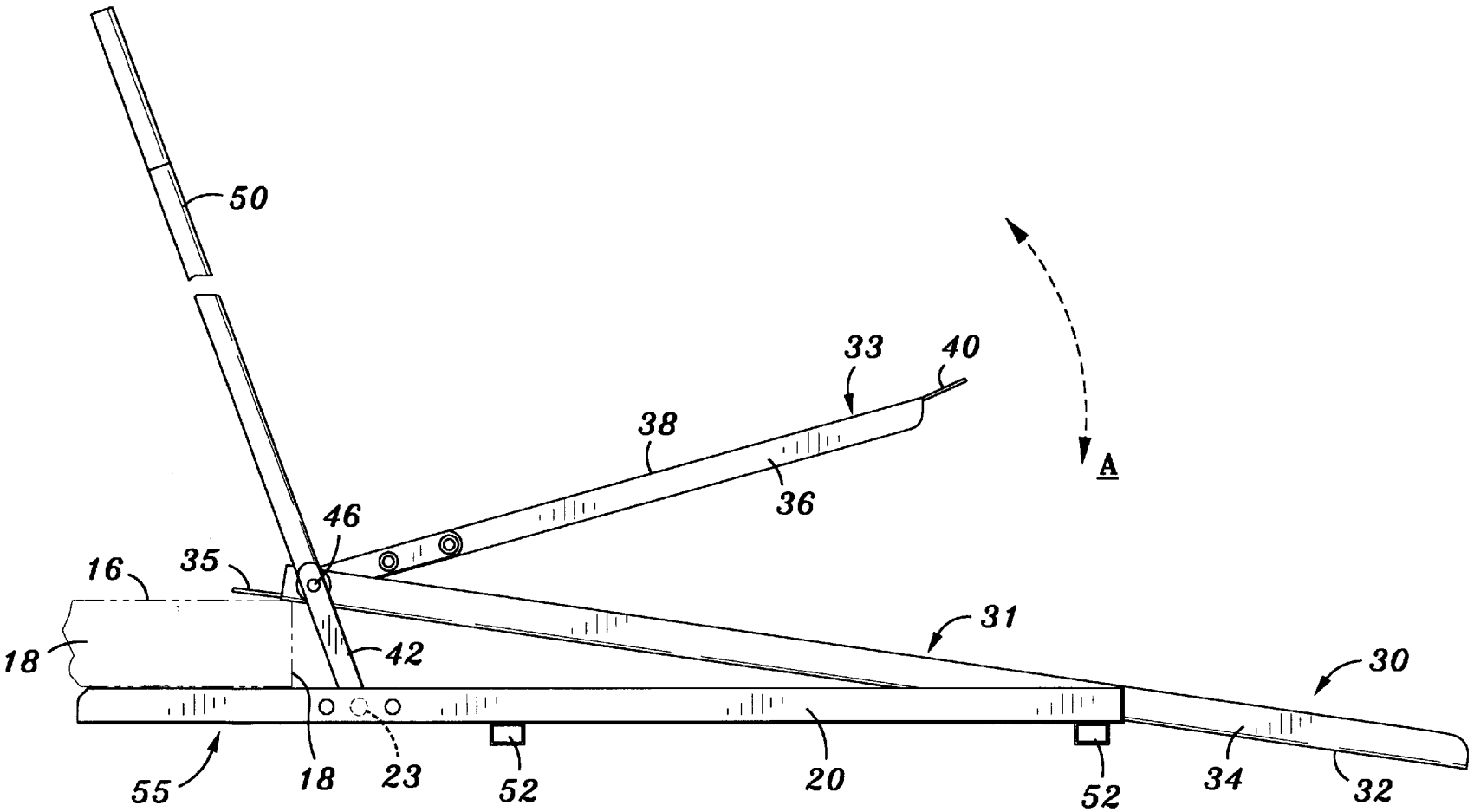
FIG. 2 is a side elevation view of the wheelchair ramp of in FIG. 1 in a partially folded/unfolded position.

With reference now in detail to the drawings, and FIG. 1 specifically, the wheelchair-accessible carousel ride 5 includes a vehicle 10 such as a chariot, as well as other animals or vehicles 11. The chariot has a vehicle floor 14. The vehicle 10 is supported on a carousel platform 18 having an upper platform surface 16 and a lower platform surface 17.

Referring still to FIG. 1, when unfolded or deployed, a wheelchair ramp 30 extends up from the ground or a loading level G to the vehicle floor 14. Accordingly, a wheelchair-bound person 100 may move up the ramp 30, with or without an assistant 110, from the loading level G to the vehicle floor surface 12. The ramp 30 may be constructed from any suitably rigid and strong material, which can properly support the weight of a wheelchair 120 and the person 100.

Figure 4:
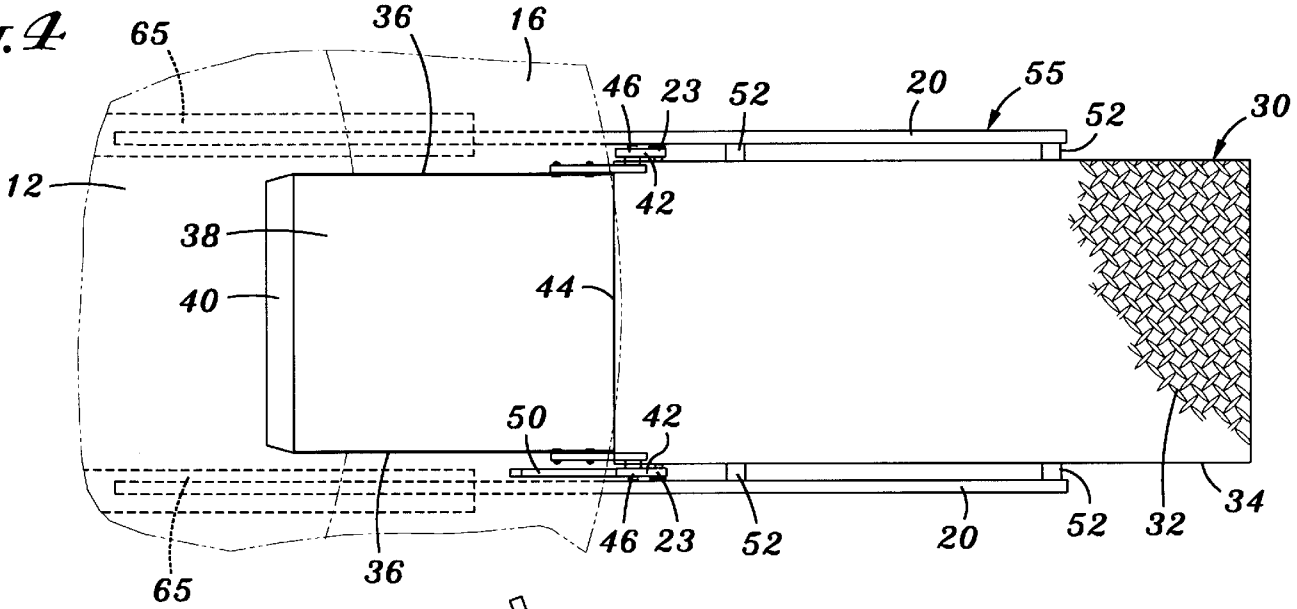
FIG. 4 is a plan view thereof.
Figure 3:
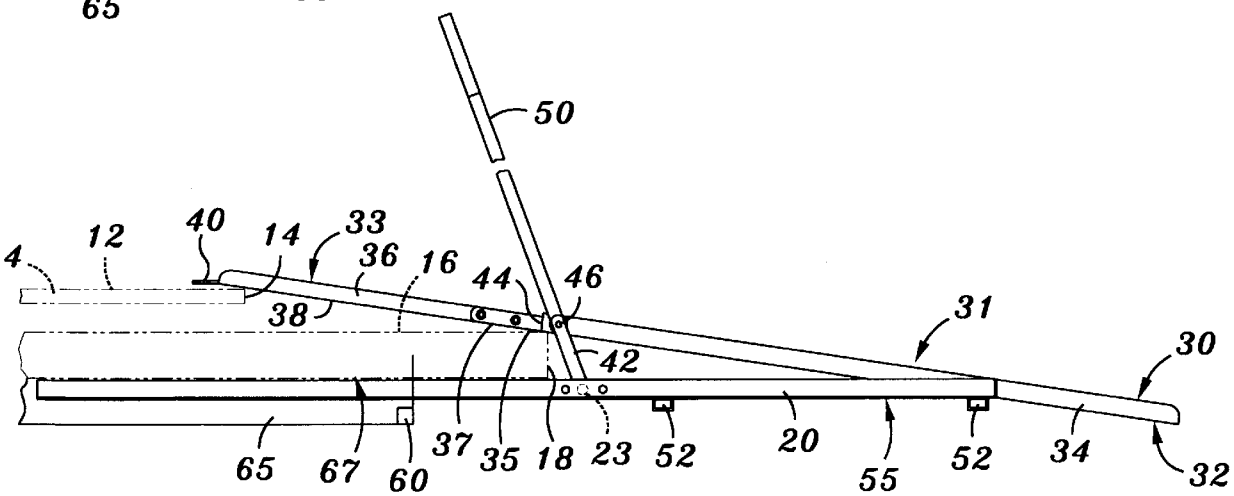
FIG. 3 is a side elevation view of the wheelchair ramp embodied in FIG. 1 fully deployed.

Referring now to FIGS. 1–4, the ramp 30 preferably includes two ramp sections. A lower or first ramp section 31 is adapted to extend from the loading level G to the carousel platform 18. An upper or second ramp section 33 is adapted to extend from the carousel platform 18 to the vehicle floor 14. The ramp sections 31 and 33 each have base plates 32 and 38 which are preferably textured or made from a slip-resistant material. When the ramp 30 is deployed, as shown in FIGS. 3 and 4, the ramp sections 31 and 33 are generally aligned and base plates 32 and 38 are generally flush along a plate joint line 44.

The lower ramp section 31 and upper ramp section 33 each have side walls 34 and 36. The side walls 34 and 36 are spaced apart sufficiently to accommodate the width or wheelbase of wheelchair wheels 124. The side walls 36 on the upper ramp section 33 are spaced slightly closer together than the side walls 34 on the lower ramp section 31, to allow the upper ramp section 33 to be folded downward onto the lower ramp section 31 for storage.

The upper ramp section 33 has a transfer lip 40 extending from its upper end and engaging the vehicle floor surface 12 to better facilitate loading/unloading of a wheelchair between the upper ramp section 33 and the vehicle 10. The lower ramp section 31 has a stop lip 35 (see FIG. 2) extending from its upper end to help support and align the upper ramp section 33 when the ramp 30 is deployed.

Referring still to FIGS. 1–4, the ramp sections 31 and 33 are pivotably attached to each other by pivot joints 46. A bed frame 55 includes a pair of generally parallel rails 20 positioned to the sides of the ramp 30 and a pair of generally parallel cross supports 52, which are attached to and bridge the rails 20. When the ramp 30 is lowered onto the bed frame 55, a bottom surface of the lower ramp section 31 comes to rest across top surfaces of the cross supports 52.

The bed frame 55 is attached to the ramp 30 through pivot links 42 located on either side of the ramp 30. Each pivot link 42 is pivotally attached at its lower end to a bedframe rail 20 through a pivot joint 23, and is pivotally attached at its upper end to the ramp 30 through a pivot joint 46. The lever arm 50 extends from and may be permanently attached to or part of the pivot link 42 on one side of the ramp 30. The pivot links 42 provide a defined arc and angle of travel for the pivot joints 46 such that, when the lever arm 50 is pivoted downward about the pivot joint 23, the upper edge of the lower ramp section 31 is lowered from the carousel platform surface 16 to the bed frame 55. Upon lowering, the lower ramp section 31 comes to rest in a generally horizontal position atop the cross supports 52. A handle 50 can be provided on both sides of the ramp, or only on one side, as shown in the drawings.

The bed frame 55 is slidably mounted on a housing assembly 65 attached to the underside 67 of the carousel platform 18. The housing assembly includes a pair of C-channel tracks into which rails 20 of the bed frame 55 are slidably received in a drawer-like manner. The rails 20 have inside and outside travel limit stops as shown in FIG. 1. The inside stop 61 limits the inward radial travel of the rails 20, so that the ramp 30, when folded and stored, is recessed slightly behind the outer perimeter of the carousel platform 18. The outside travel limit stop 63 limits the radial outward travel of the ramp so that when the rails are fully pulled out, the ramp 30 is properly positioned between the ground G and the carousel platform 18.

Other combinations of rail and housing assemblies may also be used. For example, the outer sides of rails 20 may be equipped with wheels or rollers which roll in tracks provided by the housing assembly, or the rails may include tongues extending from their outer sides which are received by grooves provided by the housing assembly. Accordingly, when the ramp 30 is not in use (e.g., during a carousel ride cycle), it may be folded and pushed back under the carousel turntable platform 18 so that it is out of the way and substantially hidden from view. Preferably, the ramp 30, when stored under the turntable platform 18, may be locked in its retracted position to secure the ramp 30 during the ride cycle.

The ramp is folded and stored under the carousel from the position shown in FIG. 1, by first manually folding the upper or second ramp section 33 up and over (as shown by the arrow A in FIG. 2) onto the lower ramp section 31. Once folded, the upper and lower nested ramp sections are lowered to a generally horizontal position on the bed frame 55 by pivoting a lever arm 50 downward and away from the vehicle or chariot 10. This lever movement first moves the first ramp back so that the stop lip clears the edge of the platform 18. As the handle continues to be moved (clockwise in FIG. 2), the ramp sections come to rest horizontally on the bedframe. In the fully folded position the handle is also horizontal. The bedframe is then pushed into or under the platform and locked into place.

The ramp is deployed by reversing the steps described above. Briefly, ramp 30 is slidably extended out from its retracted storage position under the platform 18 to its extended position, by releasing a lock 60 and manually pulling the ramp radially outwardly. The lever arm 50 is pulled upward to pivotally lift the upper edge of the lower ramp section 31 onto turntable platform surface 16. The upper ramp section 33 is unfolded to rest on the vehicle floor surface 12 at the entrance of the vehicle. Following these steps, the ramp 30 is in the fully deployed position.

Figure 5:
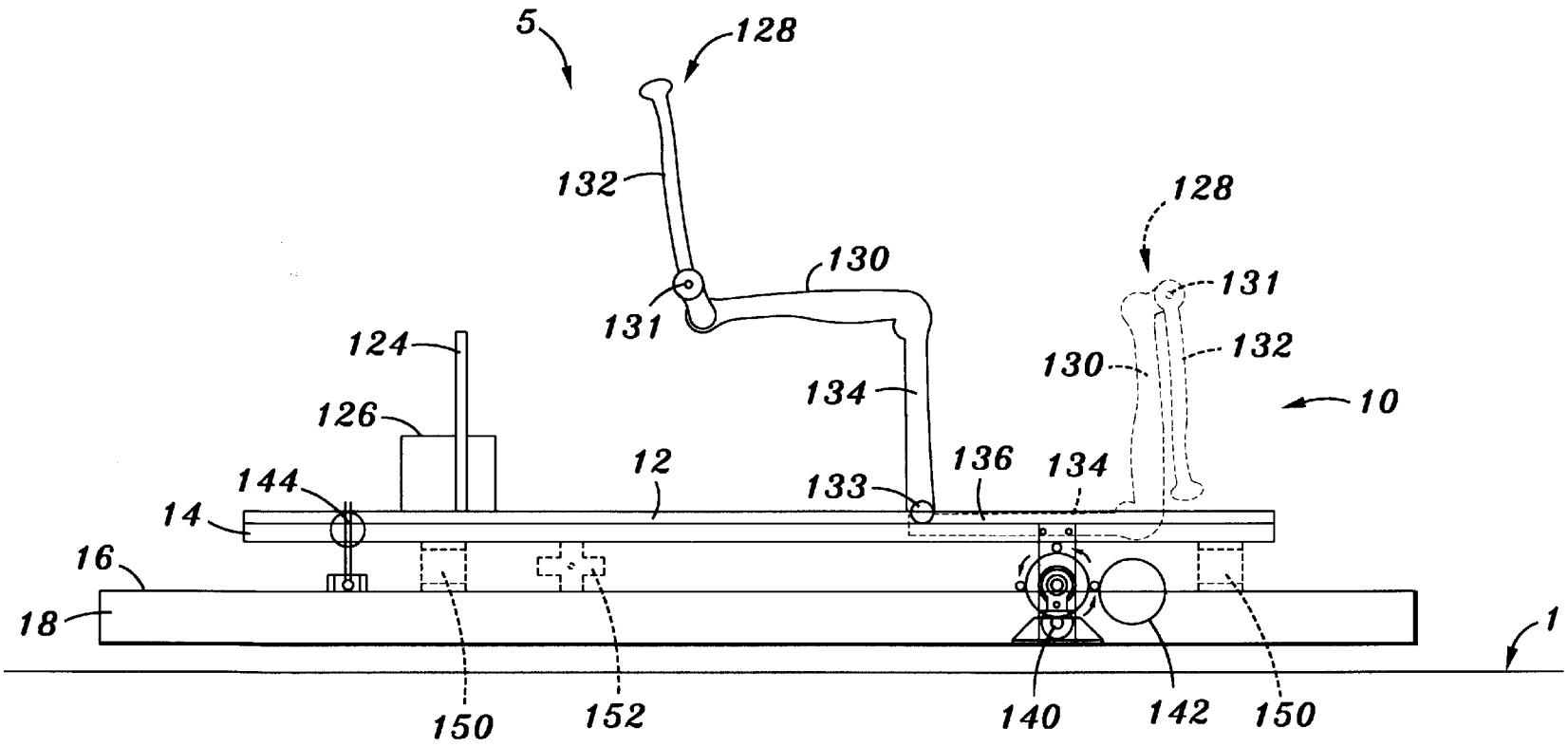
FIG. 5 is a side elevation view of a carousel vehicle.

During a typical carousel ride, the platform 18 rotates about a central axis such that character vehicles such as horses and vehicles 10 revolve in a generally circular path about the central axis. Referring now to FIG. 5, in one aspect of the invention, the vehicles 10 are designed to move up and down and/or rock during the ride. The vehicles may also be moved about different axes (pitch, roll or yaw) to enhance the ride experience. These movements can be achieved via actuators 150 forming a tripod support, with or without supporting ball or pivot joints 152. The vehicle 10 has at least one chair 128 intended for a non-wheelchair-bound passenger. The chair 128 is designed to be forwardly foldable such that it can be pivoted out of the way to accommodate a wheelchair. In the preferred embodiment, two chairs 128 are provided. In this manner, the vehicle 10 can accommodate two non-wheelchair-bound passengers or one wheelchair-bound passenger and one companion. FIG. 5 shows the chair 128 in the unfolded position in solid lines and in the folded position in phantom lines. The chair 128 includes a chairback 132 pivotally mounted to a seat 130 by chair pivot 131. The chair 128 is supported by at least one chair support 134 (e.g., a leg) which is pivotally mounted to the chariot floor 14 via a floor pivot 133.

The chariot floor 14 may have a floor groove or recess 136 for receiving the chair support 134 when the chair is folded forward. A wheelchair support 124 attached to the floor surface 12 provides an anchoring tie-down point 126 for securing a wheelchair. Tie-down means 126, preferably a belt or similar restraint, is adapted to safely secure a wheelchair during the carousel ride cycle. In addition, a belt or similar restraint is used to secure the passenger in the wheelchair and also to secure a companion in the foldable chair 128.

As shown in FIG. 5, a crankshaft 140 and a motor 142 are provided to vertically oscillate the front end of the vehicle 10, to impart a rocking motion about axle pivot 144 near the back end of the vehicle 10. Preferably, the oscillatory frequency of the vehicle 10 is similar to that of character vehicles on the carousel ride 5, so as to provide wheelchair-bound passengers riding in a carousel vehicle 10 a ride experience similar to that of non-wheelchair-bound passengers riding on character vehicles. Alternatively, other movements can be made if the actuators 150 are used.

Figure 6:
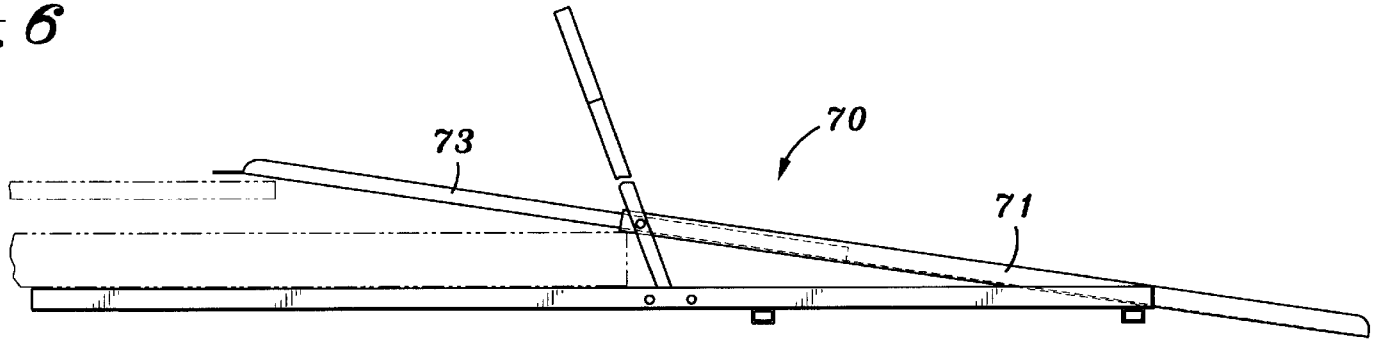
FIG. 6 is a side elevation of an alternative ramp embodiment.
Figure 7:
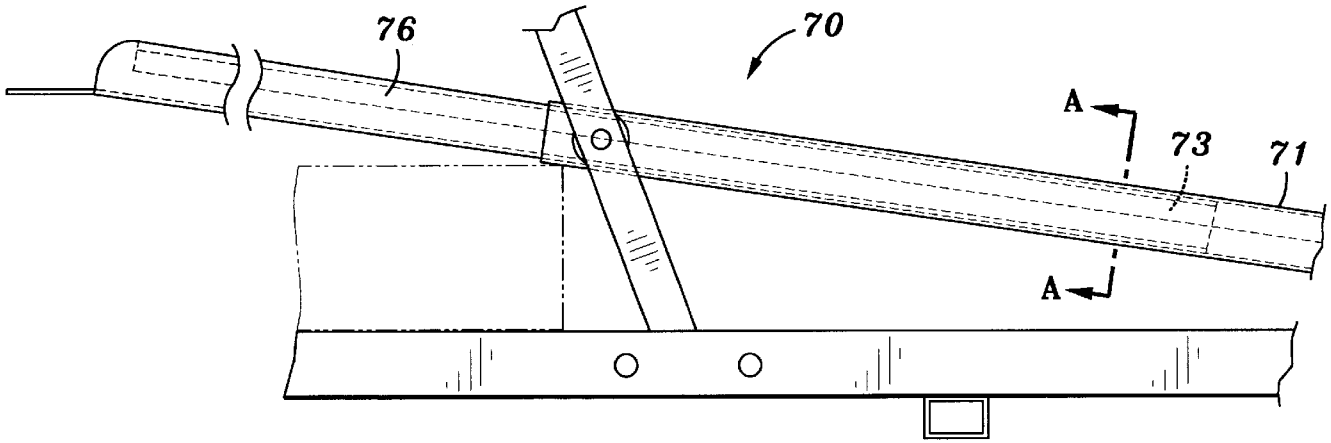
FIG. 7 is an enlarged view thereof.
Figure 8:
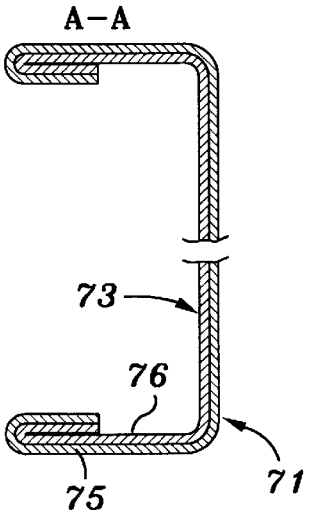
FIG. 8 is a section view taken along line A—A of FIG. 7.

Referring now to FIGS. 6, 7 and 8, which illustrate an alternative embodiment 70 of the invention, ramp sections 71 and 73, rather than being hingedly attached, are slidably attached. More specifically, side walls 75 of lower ramp section 71 are generally shaped as C-channel tracks capable of receiving side walls 76 of upper ramp section 73. Accordingly, when ramp 70 is not in use, the upper ramp section 73 may be slid downward so that it partially covers lower ramp section 71. The remaining steps outlined above for storage of the ramp 30 are substantially the same in this alternate embodiment 70.

Although particular embodiments of the present invention have been shown and described, numerous changes and modifications can of course be made without departing from the spirit and scope of the invention. For example, telescoping and rolling equivalent ramps, supported on the carousel platform, may also be used. The invention, therefore, should not be restricted to the specific designs shown, and should not otherwise be unfairly limited, except by the following claims and their equivalents.

What is claimed:

1. A carousel, comprising:

a carousel platform;

a first ramp section supported by the carousel platform;

a second ramp section pivotally attached to the first ramp section; and means for extending the first ramp section to a first position wherein the first ramp section runs from the ground up to the carousel platform, and for retracting the first ramp section to a second position wherein the first ramp section is stored on or in the carousel platform in a substantially horizontal position.

2. The carousel of claim 1 wherein the means for extending includes a bed frame slidably attached to the carousel platform and pivotably attached to at least one of the first and second ramp sections.

3. The carousel of claim 2 wherein the means for extending further comprises pivot links pivotably attached to the bed frame and to at least one of the first and second ramp sections.

4. The carousel of claim 2 wherein the means for extending further comprises a lever pivotably attached to the bed frame and to at least one of the first and second ramp sections.

5. The carousel of claim 2 wherein the bed frame is slidably supported on a lower surface of the carousel platform.

6. The carousel of claim 1 further comprising a vehicle supported on the carousel platform and having a vehicle floor, and wherein the second ramp section extends from the first ramp section up to the vehicle floor, when the ramp is in the first position.

7. The carousel of claim 6 further comprising means for raising and lowering the vehicle.

8. The carousel of claim 1 wherein the carousel platform is round.

9. The carousel of claim 8 further comprising a motor for spinning the platform.

10. A carousel comprising:

a carousel platform;

a ramp supported on the carousel platform, the ramp having a first ramp section pivotably attached to a second ramp section; and a lever arm pivotably attached to a bedframe and to the ramp, the lever arm adapted for lifting a first end of the first ramp section up off the bedframe and into a raised position.

11. The carousel of claim 8 wherein the lever arm has a lower end pivotably attached to the bedframe, and the first ramp section has an upper end pivotably attached to a mid-point of the lever arm.

12. A wheelchair-accessible carousel ride comprising:

a rotatable turntable platform having a top surface and a bottom surface;

a vehicle mounted to the top surface of the turntable platform and including a floor positioned vertically above the top surface of the turntable platform;

a bed frame slidably attached to the bottom surface of the turntable platform and slidable between a retracted and an extended position;

an extendible wheelchair ramp supported on the bed frame and including a lower ramp section and an upper ramp section; and means for moving at least one end of the vehicle up and down.

13. The carousel ride of claim 12 further comprising means on the platform for rocking the vehicle.

14. The carousel ride of claim 12 further comprising a tie-down in the vehicle for securing a wheelchair.

15. A The carousel ride of claim 12, wherein the upper and lower ramp sections are pivotably attached.

16. A method for providing wheelchair access to a carousel comprising the steps of:

withdrawing a ramp from a stored position on the carousel;

unfolding the ramp;

positioning an outer end of the ramp on the ground;

positioning an inner end of the ramp onto a top surface of the carousel;

moving a wheelchair up the ramp, from the ground, over the ramp and onto the platform; and securing the wheelchair in place in a vehicle attached to the platform and vertically oscillating the vehicle while the carousel is rotating.

17. The method of claim 16 further comprising the steps of securing the wheelchair in place with a tie-down, replacing the ramp back into the stored position, and rotating the carousel.

18. A wheelchair-accessible carousel ride comprising:

a rotatable turntable platform having a top surface and a bottom surface;

a vehicle mounted to the top surface of the turntable platform and including a floor positioned vertically above the top surface of the turntable platform;

a bed frame slidably attached to the bottom surface of the turntable platform and slidable between a retracted and an extended position;

an extendible wheelchair ramp supported on the bed frame and including a lower ramp section and an upper ramp section;

means for moving at least one end of the vehicle on the turntable platform; and a lever arm pivotally attached to the bed frame and to the ramp, the lever arm adapted for lifting the lower ramp section into contact with a top surface of the turntable platform.

19. A The carousel ride of claim 12 further comprising a housing on the bottom surface of the carousel platform, with the bed frame slidably supported in the housing.

20. A carousel, comprising:

a carousel platform;

a first ramp supported by the carousel platform;

a second ramp section pivotably attached to the first ramp section; and a bed frame slidably attached to the carousel platform and pivotably attached to at least one of the first and second ramp sections.

21. A carousel, comprising:

a carousel platform;

a first ramp section supported by the carousel platform;

a second ramp section pivotably attached to the first ramp section, the first ramp section movable to a first position wherein the first ramp section runs from the ground up to the carousel platform, and to a second position wherein the first ramp section is stored on or in the carousel platform; and a vehicle supported on the carousel platform and having a vehicle floor, and wherein the second ramp section extends from the first ramp section up to the vehicle floor, when the first ramp section is in the first position.

22. A carousel comprising:

a round carousel platform;

a pair of rails attached to a bottom surface of the carousel platform; and a ramp supported on the rails with the ramp movable from a stored position on the rails under the platform, to an extended position wherein the ramp extends from the ground to a surface on top of the platform.

* * * * *